United States Patent [19]

Clark

[11] 4,292,752

[45] Oct. 6, 1981

[54] DISPLAY SIGN

[76] Inventor: William D. Clark, 465 Alpine Heights Rd., Alpine, Calif. 92001

[21] Appl. No.: 31,437

[22] Filed: Apr. 19, 1979

Related U.S. Application Data

[63] Continuation-in-part of Ser. No. 914,014, Jun. 9, 1978, abandoned.

[51] Int. Cl.[3] ..... G09F 13/04

[52] U.S. Cl. ..... 40/576; 40/611; 40/615; 434/430

[58] Field of Search ..... 40/575, 576, 577, 615, 40/609, 611, 436, 437, 160, 16.2, 618; 35/9 A, 28, 28.3; 434/430

[56] References Cited

U.S. PATENT DOCUMENTS

| | | | |
|---|---|---|---|
| 452,111 | 5/1891 | Reamer | 40/611 |
| 1,447,918 | 3/1923 | Zacher | 40/576 |
| 1,568,630 | 1/1926 | Shearer | 40/576 |
| 1,785,145 | 12/1930 | Roll | 40/576 X |
| 2,079,230 | 5/1937 | Shively | 40/576 |
| 2,447,978 | 8/1948 | Hall | 40/611 |
| 3,014,302 | 12/1961 | Hughes | 40/615 |
| 3,381,401 | 5/1968 | Fuller, Jr. | 40/575 |
| 3,660,918 | 5/1972 | Bourseau | 40/575 X |
| 3,722,119 | 3/1973 | Braun | 40/576 X |
| 3,822,938 | 7/1974 | Hirsch | 40/367 |
| 3,895,453 | 7/1975 | Wright | 35/9 E X |
| 3,918,187 | 11/1975 | Vogele | 40/611 |

FOREIGN PATENT DOCUMENTS

| | | | |
|---|---|---|---|
| 124580 | 6/1926 | Switzerland | 40/615 |
| 1242523 | 8/1971 | United Kingdom | 40/576 |

*Primary Examiner*—Gene Mancene
*Assistant Examiner*—G. Lee Skillington
*Attorney, Agent, or Firm*—Fulwider, Patton, Rieber, Lee & Utecht

[57] ABSTRACT

A back-lighted display sign having a protective outer face panel, a copy frame positioned behind the face panel, and a number of retaining members affixed to the rear of the copy frame to receive and retain replaceable copy inserts and color filters behind the copy frame. In one disclosed embodiment, the copy inserts include a number of transparent overlays bearing characters defined by regions of contrasting transparency.

6 Claims, 7 Drawing Figures

HAMBURGER
BEEF
HAM
CHEESE
1.30
1.65
1.60
1.00
10
14
16
18
22
30
32
2
3

22'a
20'a
10
40
20'
30

10
12
20a
20
22
26
34
14
16
18

32
20
20a
16
14
22
26
18
12
30
10

26
1.65
BEEF
22

22'a
22'b
22'c
5
2
1
40

7
10
20'
22'a
34
26'
16
14
18
22'b
22'c

DISPLAY SIGN

This is a continuation-in-part of application Ser. No. 914,014, filed June 9, 1978, and subsequently abandoned.

BACKGROUND OF THE INVENTION

The present invention relates generally to display signs, and, more particularly, to back-lighted display signs suitable for use as menu and price displays in "fast food" restaurants.

In fast food restaurants, the menu and prices are typically displayed on a back-lighted panel conveniently positioned above the counter or window at which orders are placed. In some instances, the menu may be displayed in an outdoor location, especially if food may be ordered by customers while still in their cars. Ideally, such display signs should be of pleasing and colorful appearance, and, more importantly, the list of food items and accompanying prices should be conveniently accessible when the prices or items must be changed.

Prior to this invention, typical sign structures have utilized a back-lighted translucent panel on which alphabetical and numerical characters of contrasting colors are placed, such as by sliding the characters into slots or channels affixed to the face of the panel. Such display signs have the disadvantage that the letters and numbers can be inadvertently or deliberately removed or transposed. Signs of this type are also relatively inconvenient to use when the copy must be changed, since the characters must usually be fed into appropriate slots or channels one by one.

It will be appreciated, then, that there has been a need for a simple and eye-catching display sign which is protected from damage and unwanted modification, and yet is very simple and convenient to use when copy relating to the prices or items must be changed. The present invention fulfills this need.

SUMMARY OF THE INVENTION

The present invention resides in a back-lighted display sign comprising a copy frame with at least one aperture and means for mounting a copy insert behind the aperture. A preferred embodiment the display sign is back-lighted and includes a substantially transparent protective outer face panel. An alternative embodiment of the display sign has at least one copy insert including a plurality of transparent overlays. In both embodiments, the copy inserts preferably include one or more substantially flat sheets on which characters of the copy are formed by coatings or areas of contrasting transparency. For example, the areas of each of the letters can be completely transparent, while the background areas of the copy insert are translucent to light. In most installations, a source of light is placed behind the sign, and illuminates the letters of the copy insert, which are visible through the aperture of the copy frame. In the alternative embodiment of the invention, the display characters are formed on the transparent overlays and are spaced such that when the overlays are placed in fully overlapping relationship behind the copy frame, a desired array of characters is visible through the aperture.

Preferably, the sign also includes at least one color filter of substantially the same dimensions as the copy insert, the color filter being insertable behind the copy insert so that the letters of the copy are made visible in a color contrasting with that of the copy insert background areas.

In the presently preferred forms of the display sign of the present invention, the copy frame includes a plurality of apertures, each having means for receiving a copy insert on the rear face of the copy frame. Normally, the apertures are arranged in pairs, with a smaller aperture being provided to display the price in line with each larger aperture displaying the item description. Preferably, the means for receiving each of the copy inserts comprises a pair of channels affixed to the rear face of the copy frame, the channels being substantially parallel with the edges of the aperture in the frame, and being dimensioned to receive each of the copy inserts by sliding from one end of the frame.

In accordance with another aspect of the invention, copy inserts of the type referred to above, which include a plurality of copy overlays, may be utilized in display signs of various construction. The end portions of the overlays may have reduced-sized mirror image replicas of the characters contained on the face of the overlays for viewing from the rear of the display panel. The overlays also may have tabs at one end for ease of handling.

It will be apparent from the foregoing summary and from the more detailed description that follows, that the present invention provides a significant improvement in the field of display signs. In particular, it provides a display sign of pleasing and colorful appearance, and one that is conveniently changeable and yet retains the durability and security of a more permanent sign. The display sign copy may be completely protected by an outer face, and may be packaged in such a manner that the copy inserts are completely inaccessible to the public from the front of the panel. Other aspects and advantages of the present invention will become more apparent from the following more detailed description, taken in conjunction with the accompanying drawings.

DETAILED DESCRIPTION

Figure 1:
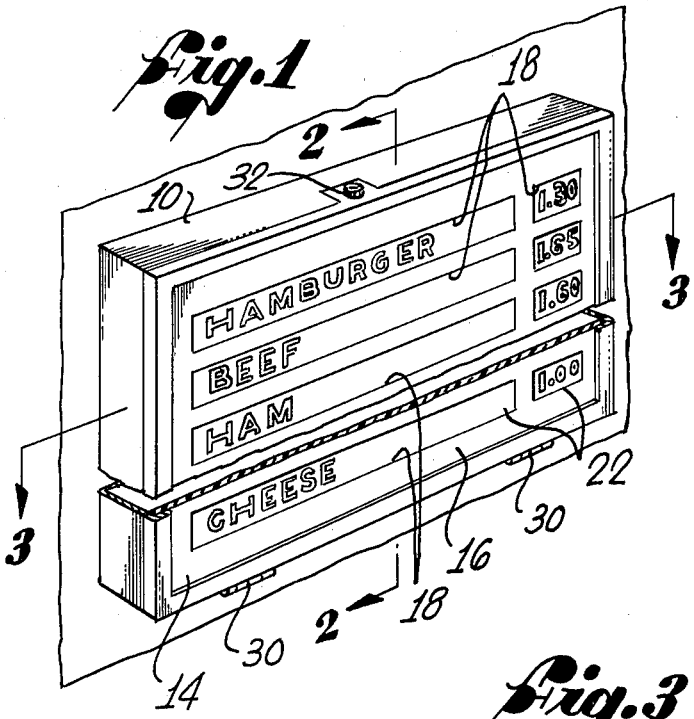
FIG. 1 is a perspective view of a display sign embodying the present invention.
Figure 7:
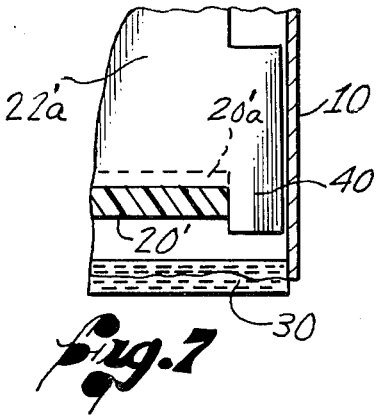
FIG. 7 is a sectional view taken substantially along the line 7—7 of FIG. 6.

As shown in the drawings for purposes of illustration, the present invention is embodied in a display sign particularly well suited for the display of menus in fast food restaurants. Typically, such signs are back-lighted and include a translucent display panel which forms the front face of a metal housing or can, indicated by reference numeral 10 in the drawings. The can 10 houses a light source, as indicated by the light bulbs 12, and may be any of a variety of types approved by local electrical codes and preferably also by Underwriters' Laboratories, Inc.

In accordance with the invention, the sign includes a substantially transparent outer face panel 14 to prevent public access to the sign, and a copy frame 16 located immediately behind the face panel, the copy frame having a plurality of apertures 18 corresponding to display areas, for the display of such items as menu selections and corresponding prices. Attached to the rear face of the copy frame 16, or integral with it, are a plurality of retaining members or guides 20 positioned above and below each of the apertures 18, and forming a channel above and below each aperture to receive a copy insert, indicated by reference numeral 22.

The guides 20 are of T-shaped or L-shaped cross section. Each guide has at least one portion 20*a* that extends in parallel relationship with the plane of the copy frame 16, but spaced back from the plane of the frame, so that a channel is formed between each guide and the rear face of the copy frame 16.

Each copy insert 22 has alphabetical or numerical characters formed on it in such a manner that the characters have a color or transparency that contrasts with that of the background areas of the insert. For example, the characters may be transparent and the background areas opaque, or vice versa. Alternatively, both the characters and the background areas could be transparent or translucent, but of contrasting colors. Preferably, the copy inserts are made from a relatively thin plastic sheet, such as a polycarbonate or Mylar material, and the copy is applied to the inserts by a silkscreen process, preferably using an acrylic vinyl ink.

Preferably, the retaining members or guides 20 are also used to retain a color filter 26, which is positioned behind the copy insert 22 to impart a different color to the transparent portions of the copy insert. The copy inserts 22 may be changed readily by opening the can 10, such as by means of the hinges 30 and lock 32 shown by way of example in FIG. 1, and replacing the appropriate copy inserts. Proper positioning of the copy inserts 22 and color filter 26 behind apertures 18 is facilitated by use of stop guides 34. It will be appreciated that the copy inserts 22 and color filters 26 can be placed in any arrangement to achieve a desired colorful display effect, and the entire assembly is completely protected by the face panel 14.

Figure 5:
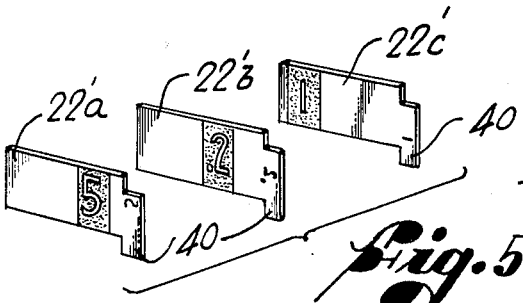
FIG. 5 is a perspective view of an alternative embodiment of a copy insert including three transparent overlays.
Figure 6:
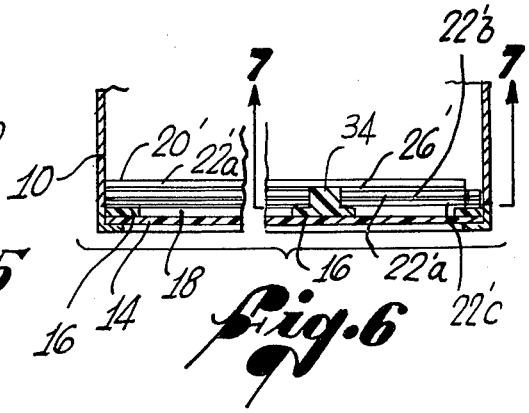
FIG. 6 is a fragmentary sectional view similar to FIG. 3, but including structural features to accommodate transparent overlays of the type shown in FIG. 5.

In another embodiment of the invention, illustrated in FIGS. 5 and 6, the copy insert 22 for the display of prices comprises a set of transparent overlays 22'*a*, 22'*b* and 22'*c*, with each overlay having one or more numerical characters formed on it. The characters on each overlay are spaced such that when several overlays are inserted behind the copy frame 16, a price, composed of the characters of each overlay, is visible through the aperture 18. With a limited library of overlays, price displays may be inexpensively and conveniently changed by replacement of one or more of the overlays.

The characters on the overlays 22'*a*, 22'*b* and 22'*c* are defined by areas of contrasting transparency. Either the characters can be formed as relatively opaque or translucent areas applied to a transparent background, or the characters can be transparent areas in an opaque or translucent background. If opaque or translucent backgrounds are employed, the background area for each character must be limited in size, to avoid obscuring adjacent characters on other overlays.

For ease of handling during insertion and removal, each overlay 22'*a*, 22'*b* and 22'*c* is provided with a transparent tab 40 at one end. Preferably, the tab of the overlay bears a reduced-size replica of the character contained on the face of the overlay. The character on the tab is a mirror image of the character on the face of the overlay, so that the tab may be read from the rear, and is positioned such that, when other overlays are inserted, the displayed price can be determined from the tabs without the necessity of viewing the front of the sign.

Figure 3:
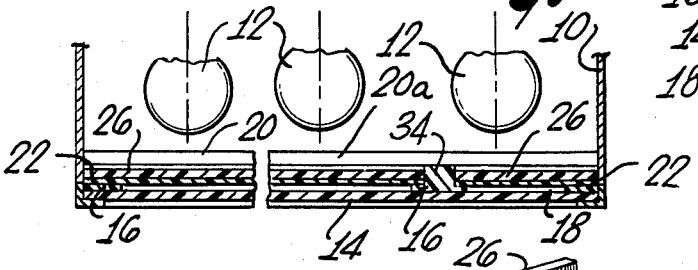
FIG. 3 is a fragmentary sectional view taken substantially along the line 3—3 of FIG. 1.
Figure 2:
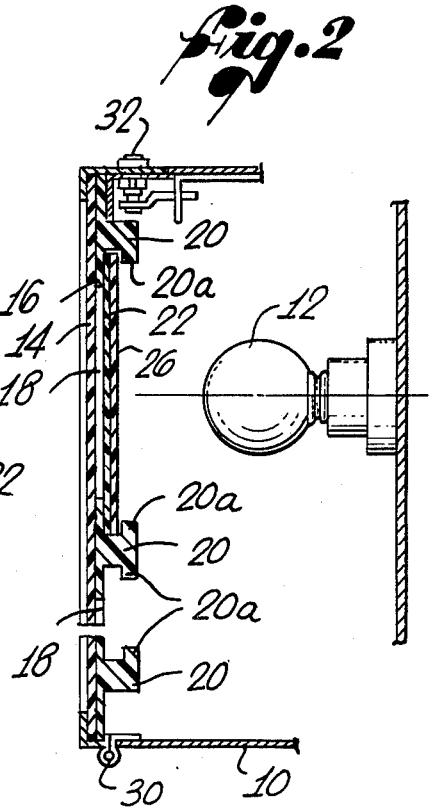
FIG. 2 is an enlarged, fragmentary, sectional view taken substantially along the line 2—2 of FIG. 1.
Figure 4:
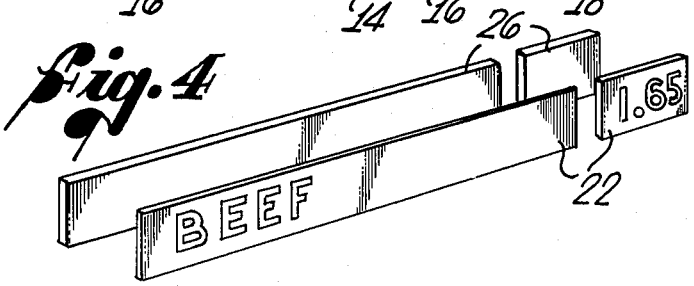
FIG. 4 is a perspective view of a pair of copy inserts and color filters for use in the display sign of FIG. 1.

As shown in FIG. 6, this embodiment of the invention may be also accommodated in the can 10, and can utilize the same transparent face panel 14, copy frame 16 and stop guide 34 as the first-described embodiment. Guides 20' are similar to the guides 20 in FIGS. 2 and 3, but do not extend all the way to the can 10 on the price display side of the sign. This provides a space to receive the overlay tabs 40. A color filter 26' may also be included, but in foreshortened form, to allow unimpaired viewing of the characters on the tabs 40 from the rear of the copy frame 16.

The copy frame 16 and guides 20 and 20' can be fabricated from any suitable material, but plastics are preferred for reasons of economy and convenience in manufacturing. The outer face panel 14 can be of either glass or plastic.

The sign constructions of the invention is particularly well suited for display signs in large restaurant chains, since the copy inserts can then be very economically produced in large quantities by a silkscreen or similar process, and distributed to all of the restaurant branches or franchises. It will be appreciated from the foregoing that the present invention represents a significant advance in the field of display signs for menus and the like. In particular, the invention provides a sign that is fully protected from inadvertent or deliberate damage or modification, but is conveniently accessible when the display copy must be changed. It will also be appreciated that, although a particular embodiment of the invention has been described in detail for purposes of illustration, various modifications may be made without departing from the spirit and scope of the invention. Accordingly, the invention is not to be limited except as by the appended claims.

I claim:

1. A back-lighted display sign comprising:

a display housing having a substantially transparent outer face panel;

a light source mounted in said housing;

a copy frame positioned behind said outer face panel and having at least one aperture therethrough;

a plurality of relatively thin copy inserts having display characters and a background area with contrasting optical properties, said display characters being positioned in different desired locations over the surfaces of said inserts;

copy retaining means affixed to the rear face of said copy frame adjacent to said aperture to hold said copy inserts in a fully overlapping relationship in said copy frame, and to provide a desired, essentially two-dimensional arrangement of said display characters; and copy insert registration means, including an integral tab on each of said copy inserts and tab retaining means defined at least in part by said copy retaining means.

2. A display sign as set forth in claim 1, wherein:

said copy retaining means includes a pair of guides formed on the rear face of said copy frame; and said tab retaining means is a gap in one of said guides, said gap being dimensioned to receive said tabs and inhibit movement of said copy inserts along said guides.

3. A display sign as set forth in claim 2, wherein said gap in one of said guides is a gap between one end of said guide and said display housing.

4. A display sign as set forth in claim 1, 2 or 3, wherein:

each of said tabs on said copy inserts has formed on the mirror image, a reduced-size replica of the corresponding character formed on said insert; and said replicas are appropriately positioned on said tabs to provide a composite mirror image replica of all of said display characters on said copy inserts, to facilitate identification of said inserts from the rear of said copy frame.

5. A display sign as set forth in claim 1, 2 or 3, wherein said display characters on said copy inserts in fully overlapping relationship provide an easily changeable price display.

6. For use in a display sign, a copy insert comprising:

a plurality of flexible copy overlays of substantially the same dimensions, each copy overlaying having a different character area bearing a character defined by regions of contrasting transparency, and each copy overlay being transparent except for portions of said character area;

wherein said copy overlays, when placed together in fully overlapping relationship in the display sign, provide a conveniently adjustable composite, two-dimensional display of an array of characters, each of which is carried by a different one of said copy overlays;

wherein each of said copy overlays has a tab at the same designated location for each overlay, and said tabs are retained together in the display sign to ensure perfect registration of said copy overlays;

and wherein tabs have reduced-sized, mirror image replicas of the characters contained on the face of the overlays, whereby said reduced-size replicas are visible when viewed from the rear of the display panel.

* * * * *